United States Patent [19]

Masuyama et al.

[11] 3,936,396

[45] Feb. 3, 1976

[54] VOLTAGE VARIABLE RESISTOR

[75] Inventors: Takeshi Masuyama, Takatsuki; Mikio Matsuura, Neyagawa; Yoshio Iida, Suita; Toshioki Amemiya, Tokyo, all of Japan

[73] Assignee: Matsushita Electric Industrial Co., Ltd., Osaka, Japan

[22] Filed: Apr. 17, 1970

[21] Appl. No.: 29,416

[30] Foreign Application Priority Data

May 2, 1969 Japan ..... 44-34928

[52] U.S. Cl. ..... 252/518

[51] Int. Cl.[2] ..... H01B 1/06

[58] Field of Search ..... 252/518, 519, 520, 54

[56] References Cited

UNITED STATES PATENTS

| | | | |
|---|---|---|---|
| 3,089,856 | 5/1963 | Cyr et al. | 252/518 |
| 3,551,356 | 12/1970 | Bowman | 252/520 |

*Primary Examiner*—Douglas J. Drummond

*Attorney, Agent, or Firm*—Wenderoth, Lind & Ponack

[57] ABSTRACT

A voltage variable resistor is provided comprising a sintered body, electrodes on opposite major surfaces of the body and leads connected to the electrodes. The sintered body consists of zinc oxide and an additive comprising 0.05 to 15.0 mole % of one member selected from the group consisting of aluminum fluoride, beryllium fluoride, cerium fluoride, nickel fluoride and vanadium fluoride.

4 Claims, 1 Drawing Figure

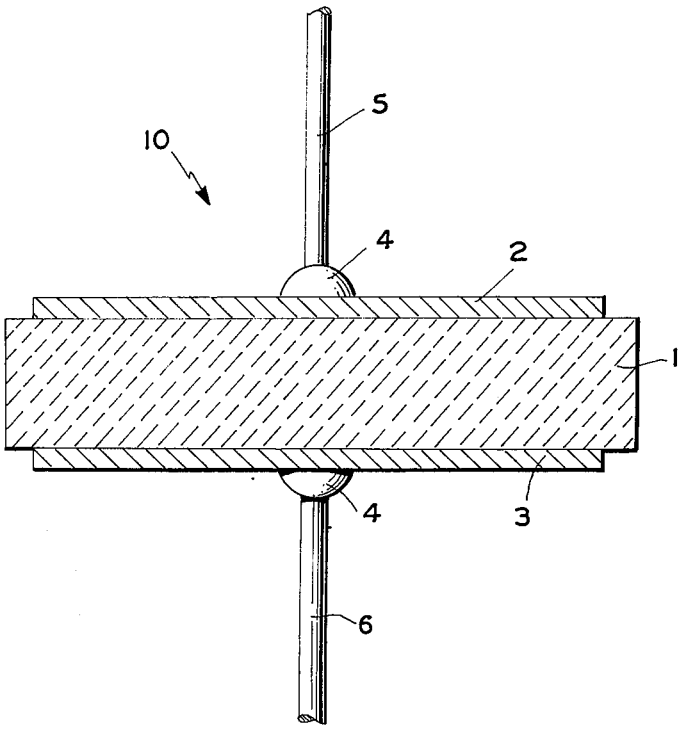
INVENTORS
TAKESHI MASUYAMA
MIKIO MATSUURA
YOSHIO IIDA
TOSHIOKI AMEMIYA
BY Wendroth, Lind & Ponack
ATTORNEYS

VOLTAGE VARIABLE RESISTOR

This invention relates to compositions of voltage variable resistor having non-ohmic resistance, and more particularly to compositions of varistors comprising zinc oxide having non-ohmic resistance due to the bulk thereof.

Various voltage variable resistors such as silicon carbide varistors, selenium rectifiers and germanium or silicon p-n junction diodes have been widely used for stabilization of voltage or current of electrical circuits. The electrical characteristics of such a voltage variable resistor are expressed by the relation:

$$I = (V/c)^n \qquad 1.$$

where V is the voltage across the resistor, I is the current flowing through the resistor, C is a constant corresponding to the voltage at a given current and exponent $n$ is a numerical value greater than 1. The value of $n$ is caluculated by the following equation:

$$n = \frac{\log_{10}(I_2/I_1)}{\log_{10}(V_2/V_1)}$$

where $V_1$ and $V_2$ are the voltage at given currents $I_1$ and $I_2$, respectively. The desired value of C depends upon the kind of application to which the resistor is to be put. It is ordinarily desirable that the value of $n$ be as large as possible since this exponent determines the extent to which the resistors depart from ohmic characteristics.

In conventional varistors comprising germanium or silicon p-n junction diodes, it is difficult to control the C-value over a wide range because the voltage variable property of these varistors is not attributed to the bulk but to the p-n junction. On the other hand, silicon carbide varistors have voltage variable properties due to the contacts among the individual grains of silicon carbide bonded together by a ceramic binding material, and the C-value is controlled by changing a dimention in a direction in which the current flows through the varistors. Silicon carbide varistors, however, have a relatively low $n$-value and are prepared by firing in non-oxidizing atmosphere, especially for the purpose of obtaining a lower C-value.

An object of the present invention is to provide a composition of a voltage variable resistor having non-ohmic properties due to the bulk thereof and having a controllable C-value.

Another object of the present invention is to provide a composition of a voltage variable resistor characterized by a high $n$-value.

These and other objects of the invention will become apparent upon consideration of the following description taken together with the accompanying drawing in which the single FIGURE is a partly cross-sectional view of a voltage variable resistor according to the invention.

Before proceeding with a detailed description of the voltage variable resistors contemplated by the invention, their construction will be described with reference to the aforesaid FIGURE of drawing wherein reference character 10 designates, as a whole, a voltage variable resistor comprising, as its active element, a sintered body having a pair of electrodes 2 and 3 applied to opposite surfaces thereof. Said sintered body 1 is prepared in a manner hereinafter set forth and is in any form such as circular, square or rectangular plate form. Wire leads 5 and 6 are attached conductively to the electrodes 2 and 3, respectively, by a connection means 4 such as solder or the like.

A voltage variable resistor according to the invention comprises a sintered body of a composition consisting essentially of as a major part, 85.0 to 99.95 mole % of zinc oxide and, as an additive, 0.05 to 15.0 mole % of one member selected from the group consisting of aluminum fluoride, beryllium fluoride, cerium fluoride, nickel fluoride, and vanadium fluoride. Such a voltage variable resistor has non-ohmic resistances due to the bulk itself. Therefore, its C-value can be changed without impairing the $n$-value by changing the distance between said opposite surfaces. The shorter distance results in the lower C-value.

The higher n-value can be obtained when said sintered body consists essentially of a batch composition listed in Table 1.

Table 2 shows operable and preferable batch compositions of said sintered body for producing a voltage variable resistor having an $n$-value higher than 8 and a high stability with temperature, humidity and electric load.

According to the invention, the $n$-value higher than 20 can be obtained when said sintered body consists essentialy of a batch composition listed in Table 3.

The sintered body 1 can be prepared by a per se well known ceramic technique. The starting materials of the compositions described in the foregoing description are mixed in a wet mill so as to produce homogeneous mixtures. The mixtures are dried and pressed in a mold into desired shapes at a pressure from 100 Kg/cm$^2$ to 1000 Kg/cm$^2$. The pressed bodies are sintered in air at a given temperature for 1 to 3 hours, and then furnace-cooled to room temperature (about 15° to about 30°C).

The available sintering temperature is determined in view of electrical resistivity, non-linearity and stability and ranges from 1000° to 1450°C.

The mixtures can be preliminarily calcined at about 700°C and pulverized for easy fabrication in the subsequent pressing step. The mixture to be pressed can be admixed with a suitable binder such as water, polyvinyl alcohol, etc.

It is advantageous that the sintered body be lapped at the opposite surfaces by abrasive powder such as silicon carbide in a particle size of 300 meshes to 1500 meshes.

The sintered bodies are provided, at the opposite surfaces thereof, with electrodes in any available and suitable method such as electroplating method, vacuum evaporation method, metallizing method by spraying or silver painting method.

The voltage variable properties are not practically affected by the kinds of electrodes used, but are affected by the thickness of the sintered bodies. Particularly, the C-value varies in proportion to the thickness of the sintered bodies, while the $n$-value is almost independent of the thickness. This surely means that the voltage variable property is due to the bulk of the body, but not to the electrode.

Lead wires can be attached to the electrodes in a per se conventional manner by using conventional solder having a low melting point. It is convenient to employ a conductive adhesive comprising silver powder and resin in an organic solvent in order to connect the lead wires to the electrodes.

Voltage variable resistors according to this invention have a high stability to temperature and in the load life test, which is carried out at 70°C at a rating power for 500 hours. The *n*-value and C-value do not change remarkably after heating cycles and load life test. It is advantageous for achievement of a high stability ao humidity that the resultant voltage variable resistors are embedded in a humidity proof resin such as epoxy resin and phenol resin in a per se well known manner.

Presently preferred illustrative embodiments of the invention are as follows.

EXAMPLE 1

A mixture of zinc oxide and additive in a composition of Table 4 are mixed in a wet mill for 3 hours. The mixture is dried and then calcined at 700°C for 1 hour. The calcined mixture is pulverized by the motor-driven ceramic mortar for 30 minutes and then pressed in a mold into a shape of 17.5 mm in diameter and 2.5 mm in thickness at a pressure of 500 Kg/cm$^2$.

The pressed body is sintered in air at 1350°C for 1 hour, and then furnace-cooled to room temperature (about 15° to about 30°C). The sintered disc is lapped at the opposite surfaces thereof by silicon carbide in a particle size of 600 meshes. Resulting sintered disc has a size of 14 mm in diameter and 1.5 mm in thickness. The silver paint electrodes commercially available are attached to the opposite surfaces of sintered disc by painting. Then lead wires are attached to the silver elecrotes by soldering. The electric characteristics of the resultant resistors are shown in Table 4. It will be readily understood that the zinc oxide sintered body incorporated with additives listed in Table 4 is available for the voltage variable resistor, and particularly the higher value of n can be obtained when bismuth oxide or the combination of bismuth oxide with cobalt oxide and/or manganese oxide is further added to said additive.

EXAMPLE 2

Starting materials composed of zinc oxide and additive listed in Table 5 are mixed, dried, calcined and pulverized in the same manner as those of Example 1. The pulverized mixture is pressed in a mold into a disc of 17.5 mm in diameter and 5 mm in thickness at a pressure of 500 Kg/cm$^2$.

The present body is sintered in air at 1350°C for 1 hour, and then furnace-cooled to room temperature. The sintered disc is ground at the opposite surfaces thereof into the thickness shown in Table 5 by silicon carbide in a particle size of 600 meshes. The ground disc is provided with the electrodes and lead wires at the opposite surface in a manner similar to that of Example 1. The electric characteristics of the resultant resistors are shown in Table 5; the C-value varies approximately in proportion to the thickness of the sintered disc while the *n*-value is essentially independent of the thickness. It will be readily realized that the voltage nonlinear properties of the resistors are attributed to the sintered body itself.

EXAMPLE 3

Zinc oxide incorporated with additive in the composition of Table 6 is fabricated into the voltage variable resistors by the same process as that of Example 1. The resulting resistors are tested according to the methods used in the electronic components parts. The load life test is carried out at 70°C ambient temperature at 0.5 watt rating power for 500 hours. The heating cycle test is carried out by repeating 5 times the cycle in which said resistors are kept at 85°C ambient temperature for 30 minutes, cooled rapidly to −20°C and then kept at such temperature for 30 minutes. Table 6 shows a difference in C-values and n-values after the load life test. It can be readily realized that the zinc oxide sintered body incorporated with additives listed in Table 6, particularly when bismuth oxide or combination of bismuth oxide with cobalt oxide and/or manganese oxide is added to said additive, is effective for the electrical and environmental stability.

Table 1

| Zinc Oxide (mole %) | Additive (mole %) | |
|---|---|---|
| 99.0–99.9 | Aluminum fluoride | 0.1–1.0 |
| 99.0–99.5 | Beryllium fluoride | 0.5–1.0 |
| 99.0–99.5 | Cerium fluoride | 0.5–1.0 |
| 97.5–99.5 | Nickel fluoride | 0.5–2.5 |
| 98.0–99.0 | Vanadium fluoride | 1.0–2.0 |

Table 2

| | Zinc oxide (mole %) | Bismuth (mole %) | Cobalt (mole %) | Manganese (mole %) | Further (mole %) |
|---|---|---|---|---|---|
| | 96.0–99.8 | 0.1–3.0 | — | — | Aluminum fluoride 0.1–1.0 |
| oper- | 96.0–99.4 | 0.1–3.0 | — | — | Beryllium fluoride 0.5–1.0 |
| able | 96.0–99.4 | 0.1–3.0 | — | — | Cerium fluoride 0.5–1.0 |
| | 94.5–99.4 | 0.1–3.0 | — | — | Nickel fluoride 0.5–2.5 |
| | 95.0–98.9 | 0.1–3.0 | — | — | Vanadium fluoride 1.0–2.0 |
| | 93.0–99.7 | 0.1–3.0 | 0.1 3.0 | — | Aluminum fluoride 0.1–1.0 |
| | 93.0–99.3 | 0.1–3.0 | 0.1 3.0 | — | Beryllium fluoride 0.5–1.0 |
| | 93.0–99.3 | 0.1–3.0 | 0.1 3.0 | — | Cerium fluoride 0.5–1.0 |
| | 91.5–99.3 | 0.1–3.0 | 0.1 3.0 | — | Nickel fluoride 0.5–2.5 |
| pref- | 92.0–98.8 | 0.1–3.0 | 0.1 3.0 | — | Vanadium fluoride 1.0–2.0 |
| | 93.0–99.7 | 0.1–3.0 | — | 0.1 3.0 | Aluminum fluoride 0.1–1.0 |
| erable | 93.0–99.3 | 0.1–3.0 | — | 0.1 3.0 | Beryllium fluoride 0.5–1.0 |
| | 93.0–99.3 | 0.1–3.0 | — | 0.1 3.0 | Cerium fluoride 0.5–1.0 |
| | 91.5–99.3 | 0.1–3.0 | — | 0.1 3.0 | Nickel fluoride 0.5–2.5 |
| | 92.0–98.8 | 0.1–3.0 | — | 0.1 3.0 | Vanadium fluoride 1.0–2.0 |

Table 3

| Zinc oxide (mole %) | Bismuth oxide (mole %) | Cobalt oxide (mole %) | Manganese oxide (mole %) | Further additives (mole %) |
|---|---|---|---|---|
| 90.0–99.6 | 0.1–3.0 | 0.1–3.0 | 0.1–3.0 | Aluminum fluoride 0.1–1.0 Beryllium |

Table 3-continued

| Zinc oxide (mole %) | Bismuth oxide (mole %) | Cobalt oxide (mole %) | Manganese oxide (mole %) | Further additives (mole %) |
|---|---|---|---|---|
| 90.0–99.2 | 0.1–3.0 | 0.1–3.0 | 0.1–3.0 | fluoride 0.5–1.0 |
| 90.0–99.2 | 0.1–3.0 | 0.1–3.0 | 0.1–3.0 | Cerium fluoride 0.5–1.0 |
| 88.5–99.2 | 0.1–3.0 | 0.1–3.0 | 0.1–3.0 | Nickel fluoride 0.5–2.5 |
| 89.0–98.7 | 0.1–3.0 | 0.1–3.0 | 0.1–3.0 | Vanadium fluoride 1.0–2.0 |

Table 4

| Starting Materials (mole %) | | | | Electric Characteristics of Resultant Resistors | |
|---|---|---|---|---|---|
| Bismuth oxide | Cobalt oxide | Manganese oxide | Fluoride | C (at 1mA) | n |
| | | | Aluminum fluoride | | |
| — | — | — | 0.05 | 8 | 2.1 |
| — | — | — | 0.1 | 13 | 3.5 |
| — | — | — | 0.3 | 38 | 5.7 |
| — | — | — | 1.0 | 78 | 3.2 |
| — | — | — | 15.0 | 102 | 2.0 |
| 0.1 | — | — | 0.1 | 45 | 8.8 |
| 0.1 | — | — | 1.0 | 72 | 9.4 |
| 3.0 | — | — | 0.1 | 86 | 9.8 |
| 3.0 | — | — | 1.0 | 132 | 10.4 |
| 0.5 | — | — | 0.3 | 84 | 11.4 |
| 0.1 | 0.1 | — | 0.1 | 63 | 13.7 |
| 0.1 | 0.1 | — | 1.0 | 75 | 13.9 |
| 0.1 | 3.0 | — | 0.1 | 80 | 14.2 |
| 0.1 | 3.0 | — | 1.0 | 92 | 14.4 |
| 3.0 | 0.1 | — | 0.1 | 76 | 14.9 |
| 3.0 | 0.1 | — | 1.0 | 85 | 15.4 |
| 3.0 | 3.0 | — | 0.1 | 80 | 15.2 |
| 3.0 | 3.0 | — | 1.0 | 90 | 15.8 |
| 0.5 | 0.5 | — | 0.3 | 142 | 18.2 |
| 0.1 | — | 0.1 | 0.1 | 50 | 13.2 |
| 0.1 | — | 0.1 | 1.0 | 55 | 14.3 |
| 0.1 | — | 3.0 | 0.1 | 65 | 14.8 |
| 0.1 | — | 3.0 | 1.0 | 70 | 15.8 |
| 3.0 | — | 0.1 | 0.1 | 63 | 16.0 |
| 3.0 | — | 0.1 | 1.0 | 78 | 16.2 |
| 3.0 | — | 3.0 | 0.1 | 81 | 16.8 |
| 3.0 | — | 3.0 | 1.0 | 90 | 17.0 |
| 0.5 | — | 0.5 | 0.3 | 96 | 18.9 |
| 0.1 | 0.1 | 0.1 | 0.1 | 91 | 22.4 |
| 0.1 | 0.1 | 0.1 | 1.0 | 95 | 22.9 |
| 0.1 | 0.1 | 3.0 | 0.1 | 92 | 23.1 |
| 0.1 | 0.1 | 3.0 | 1.0 | 87 | 24.1 |
| 0.1 | 3.0 | 0.1 | 0.1 | 89 | 23.4 |
| 0.1 | 3.0 | 0.1 | 1.0 | 99 | 23.1 |
| 0.1 | 3.0 | 3.0 | 0.1 | 98 | 24.1 |
| 0.1 | 3.0 | 3.0 | 1.0 | 105 | 23.2 |
| 3.0 | 0.1 | 0.1 | 0.1 | 97 | 24.1 |
| 3.0 | 0.1 | 0.1 | 1.0 | 102 | 24.3 |
| 3.0 | 0.1 | 3.0 | 0.1 | 104 | 24.1 |
| 3.0 | 0.1 | 3.0 | 1.0 | 132 | 23.2 |
| 3.0 | 3.0 | 0.1 | 0.1 | 104 | 24.5 |
| 3.0 | 3.0 | 0.1 | 1.0 | 115 | 25.1 |
| 3.0 | 3.0 | 3.0 | 0.1 | 109 | 25.5 |
| 3.0 | 3.0 | 3.0 | 1.0 | 132 | 24.9 |
| 0.5 | 0.5 | 0.5 | 0.3 | 123 | 28.4 |
| | | | Belirium fluoride | | |
| — | — | — | 0.05 | 2 | 1.9 |
| — | — | — | 0.5 | 5 | 3.4 |
| — | — | — | 0.8 | 7 | 3.8 |
| — | — | — | 1.0 | 8 | 3.0 |
| — | — | — | 15.0 | 18 | 2.1 |
| 0.1 | — | — | 0.5 | 13 | 9.0 |
| 0.1 | — | — | 1.0 | 24 | 9.6 |
| 3.0 | — | — | 0.5 | 39 | 9.7 |
| 3.0 | — | — | 1.0 | 45 | 8.8 |
| 0.5 | — | — | 0.8 | 10 | 10.1 |
| 0.1 | 0.1 | — | 0.5 | 35 | 12.4 |
| 0.1 | 0.1 | — | 1.0 | 48 | 12.5 |
| 0.1 | 3.0 | — | 1.0 | 68 | 14.3 |
| 3.0 | 0.1 | — | 1.0 | 72 | 16.0 |

Table 4-continued

| Starting Materials (mole %) | | | | Electric Characteristics of Resultant Resistors | |
|---|---|---|---|---|---|
| Bismuth oxide | Cobalt oxide | Manganese oxide | Fluoride | C (at 1mA) | n |
| 3.0 | 3.0 | — | 1.0 | 98 | 15.2 |
| 0.5 | 0.5 | — | 0.8 | 62 | 18.4 |
| 0.1 | — | 0.1 | 0.5 | 50 | 16.2 |
| 0.1 | — | 3.0 | 0.5 | 89 | 15.4 |
| 3.0 | — | 0.1 | 0.5 | 95 | 13.3 |
| 3.0 | — | 3.0 | 0.5 | 123 | 14.4 |
| 0.5 | — | 0.5 | 0.8 | 78 | 18.0 |
| 0.1 | 0.1 | 0.1 | 0.5 | 102 | 20.4 |
| 0.1 | 0.1 | 0.1 | 1.0 | 109 | 21.0 |
| 0.1 | 3.0 | 0.1 | 0.5 | 132 | 24.5 |
| 0.1 | 3.0 | 0.1 | 1.0 | 140 | 23.8 |
| 0.1 | 3.0 | 3.0 | 1.0 | 162 | 24.4 |
| 3.0 | 0.1 | 0.1 | 0.5 | 138 | 23.2 |
| 3.0 | 0.1 | 3.0 | 0.5 | 154 | 20.4 |
| 3.0 | 3.0 | 0.1 | 1.0 | 173 | 21.3 |
| 3.0 | 3.0 | 3.0 | 0.5 | 180 | 22.9 |
| 3.0 | 3.0 | 3.0 | 1.0 | 195 | 23.3 |
| 0.5 | 0.5 | 0.5 | 0.8 | 114 | 26.2 |
| | | | Cerium fluoride | | |
| — | — | — | 0.05 | 0.7 | 1.8 |
| — | — | — | 0.5 | 2.8 | 4.5 |
| — | — | — | 0.8 | 3.3 | 5.2 |
| — | — | — | 1.0 | 5.8 | 4.8 |
| — | — | — | 15.0 | 29 | 2.0 |
| 0.1 | — | — | 0.5 | 63 | 8.1 |
| 0.1 | — | — | 1.0 | 69 | 8.6 |
| 3.0 | — | — | 0.5 | 82 | 9.2 |
| 3.0 | — | — | 1.0 | 98 | 8.3 |
| 0.5 | — | — | 0.8 | 72 | 11.2 |
| 0.1 | 0.1 | — | 0.5 | 83 | 14.5 |
| 0.1 | 0.1 | — | 1.0 | 89 | 16.2 |
| 0.1 | 3.0 | — | 1.0 | 94 | 15.3 |
| 3.0 | 0.1 | — | 1.0 | 102 | 15.4 |
| 3.0 | 3.0 | — | 1.0 | 121 | 14.7 |
| 0.5 | 0.5 | — | 0.8 | 93 | 18.9 |
| 0.1 | — | 0.1 | 0.5 | 78 | 13.3 |
| 0.1 | — | 3.0 | 0.5 | 85 | 17.5 |
| 3.0 | — | 0.1 | 0.5 | 83 | 15.8 |
| 3.0 | — | 3.0 | 0.5 | 92 | 14.2 |
| 0.5 | — | 0.5 | 0.8 | 87 | 18.2 |
| 0.1 | 0.1 | 0.1 | 0.5 | 68 | 20.8 |
| 0.1 | 0.1 | 0.1 | 1.0 | 79 | 22.2 |
| 0.1 | 3.0 | 0.1 | 0.5 | 80 | 23.4 |
| 0.1 | 3.0 | 0.1 | 1.0 | 96 | 26.2 |
| 0.1 | 3.0 | 3.0 | 1.0 | 101 | 25.2 |
| 3.0 | 0.1 | 0.1 | 0.5 | 125 | 24.3 |
| 3.0 | 0.1 | 3.0 | 0.5 | 133 | 20.5 |
| 3.0 | 3.0 | 0.1 | 1.0 | 150 | 23.4 |
| 3.0 | 3.0 | 3.0 | 0.5 | 162 | 26.2 |
| 3.0 | 3.0 | 3.0 | 1.0 | 172 | 25.4 |
| 0.5 | 0.5 | 0.5 | 0.8 | 134 | 29.3 |
| | | | Nickel fluoride | | |
| — | — | — | 0.05 | 4.5 | 2.1 |
| — | — | — | 0.5 | 5.3 | 4.3 |
| — | — | — | 1.0 | 8.1 | 5.2 |
| — | — | — | 2.5 | 32 | 4.6 |
| — | — | — | 15.0 | 42 | 1.8 |
| 0.1 | — | — | 0.5 | 18 | 9.8 |
| 0.1 | — | — | 2.5 | 25 | 8.1 |
| 3.0 | — | — | 0.5 | 33 | 8.8 |
| 3.0 | — | — | 2.5 | 53 | 10.2 |
| 0.5 | — | — | 1.0 | 62 | 12.1 |
| 0.1 | 0.1 | — | 0.5 | 42 | 14.2 |
| 0.1 | 3.0 | — | 0.5 | 75 | 14.2 |
| 3.0 | 0.1 | — | 0.5 | 66 | 14.5 |
| 3.0 | 3.0 | — | 0.5 | 72 | 15.6 |
| 0.5 | 0.5 | — | 1.0 | 84 | 18.8 |
| 0.1 | — | 0.1 | 0.5 | 48 | 14.4 |
| 0.1 | — | 0.1 | 2.5 | 75 | 14.8 |
| 0.1 | — | 3.0 | 2.5 | 91 | 15.3 |
| 3.0 | — | 0.1 | 2.5 | 92 | 15.2 |
| 3.0 | — | 3.0 | 2.5 | 89 | 16.3 |
| 0.5 | — | 0.1 | 1.0 | 104 | 19.4 |
| 0.1 | 0.1 | 0.1 | 0.5 | 98 | 23.4 |
| 0.1 | 0.1 | 3.0 | 0.5 | 101 | 23.3 |
| 0.1 | 0.1 | 3.0 | 2.5 | 121 | 23.1 |
| 0.1 | 3.0 | 3.0 | 0.5 | 130 | 24.4 |
| 0.1 | 3.0 | 3.0 | 2.5 | 141 | 24.1 |
| 3.0 | 0.1 | 0.1 | 0.5 | 120 | 24.5 |
| 3.0 | 0.1 | 0.1 | 2.5 | 121 | 24.4 |
| 3.0 | 0.1 | 3.0 | 2.5 | 138 | 25.3 |
| 3.0 | 3.0 | 0.1 | 0.5 | 166 | 26.6 |

Table 4-continued

| Starting Materials (mole %) | | | | Electric Characteristics of Resultant Resistors | |
|---|---|---|---|---|---|
| Bismuth oxide | Cobalt oxide | Manganese oxide | Fluoride | C (at 1mA) | n |
| 3.0 | 3.0 | 3.0 | 2.5 | 185 | 25.1 |
| 0.5 | 0.5 | 0.5 | 1.0 | 133 | 29.8 |
| | | | Vanadium fluoride | | |
| — | — | — | 0.05 | 3 | 2.1 |
| — | — | — | 1.0 | 8 | 4.3 |
| — | — | — | 1.5 | 12 | 5.5 |
| — | — | — | 2.0 | 24 | 4.8 |
| — | — | — | 15.0 | 58 | 2.4 |
| 0.1 | — | — | 1.0 | 45 | 9.2 |
| 0.1 | — | — | 2.0 | 53 | 8.5 |
| 3.0 | — | — | 1.0 | 60 | 9.5 |
| 3.0 | — | — | 2.0 | 65 | 10.3 |
| 0.5 | — | — | 1.5 | 72 | 12.5 |
| 0.1 | 0.1 | — | 1.0 | 95 | 14.7 |
| 0.1 | 0.1 | — | 2.0 | 114 | 15.0 |
| 0.1 | 3.0 | — | 2.0 | 89 | 14.8 |
| 3.0 | 0.1 | — | 2.0 | 103 | 16.2 |
| 3.0 | 3.0 | — | 2.0 | 105 | 15.3 |
| 0.5 | 0.5 | — | 1.5 | 132 | 18.4 |
| 0.1 | — | 0.1 | 0.1 | 79 | 14.0 |
| 0.1 | — | 3.0 | 1.0 | 82 | 14.1 |
| 3.0 | — | 0.1 | 1.0 | 85 | 15.3 |
| 3.0 | — | 3.0 | 1.0 | 76 | 16.1 |
| 0.5 | — | 0.5 | 1.5 | 98 | 19.4 |
| 0.1 | 0.1 | 0.1 | 1.0 | 106 | 24.1 |
| 0.1 | 0.1 | 0.1 | 2.0 | 120 | 23.5 |
| 0.1 | 3.0 | 0.1 | 1.0 | 85 | 22.4 |
| 0.1 | 3.0 | 0.1 | 2.0 | 105 | 21.2 |
| 0.1 | 3.0 | 3.0 | 2.0 | 143 | 23.1 |
| 3.0 | 0.1 | 0.1 | 1.0 | 168 | 25.3 |
| 3.0 | 0.1 | 3.0 | 1.0 | 152 | 27.1 |
| 3.0 | 3.0 | 0.1 | 2.0 | 170 | 26.6 |
| 3.0 | 3.0 | 3.0 | 1.0 | 198 | 25.4 |
| 3.0 | 3.0 | 3.0 | 2.0 | 204 | 27.6 |
| 0.5 | 0.5 | 0.5 | 1.5 | 153 | 33.1 |

Table 5

| Additive (mole %) | Thickness (mm) | C (at 1mA) | n |
|---|---|---|---|
| | initial (4.1) | 94 | 5.8 |
| | 3.5 | 81 | 5.7 |
| Aluminum fluoride 0.3 | 3.0 | 76 | 5.9 |
| | 2.5 | 58 | 5.8 |
| | 2.0 | 44 | 5.7 |
| | 1.5 | 38 | 5.7 |
| | 1.0 | 23 | 5.8 |
| | initial (4.1) | 19 | 3.8 |
| | 3.5 | 16 | 3.7 |
| Beryllium fluoride 0.8 | 3.0 | 14 | 3.6 |
| | 2.5 | 12 | 3.8 |
| | 2.0 | 9.5 | 3.5 |
| | 1.5 | 7.0 | 3.8 |
| | 1.0 | 4.7 | 3.5 |
| | initial (4.1) | 8.6 | 5.2 |
| | 3.5 | 7.3 | 5.3 |
| Cerium fluoride 0.8 | 3.0 | 6.3 | 5.1 |
| | 2.5 | 5.3 | 5.2 |
| | 2.0 | 4.3 | 5.1 |
| | 1.5 | 3.3 | 5.2 |
| | 1.0 | 2.1 | 5.2 |
| | initial (4.1) | 22 | 5.2 |
| | 3.5 | 19 | 5.1 |
| Nickel fluoride 1.0 | 3.0 | 16 | 5.1 |
| | 2.5 | 14 | 5.3 |
| | 2.0 | 11 | 5.2 |
| | 1.5 | 8.1 | 5.2 |
| | 1.0 | 5.4 | 5.1 |
| | initial (4.1) | 33 | 5.6 |
| | 3.5 | 28 | 5.5 |
| Vanadium fluoride 1.5 | 3.0 | 24 | 5.5 |
| | 2.5 | 20 | 5.4 |
| | 2.0 | 15 | 5.6 |
| | 1.5 | 12 | 5.5 |
| | 1.0 | 7.9 | 5.5 |

Table 6

| Additive (mole %) | | | | Change rates of electrical characteristics after test | | | |
|---|---|---|---|---|---|---|---|
| | | | | Load life test (%) | | Heat cycle test (%) | |
| Bismuth oxide | Cobalt oxide | Manganese oxide | Fluoride | Δc | Δn | Δc | Δn |
| | | | Aluminum fluoride | | | | |
| 0.1 | — | — | 0.1 | −13.0 | −15.0 | −18.2 | −19.2 |
| 0.1 | — | — | 1.0 | −12.4 | −14.0 | −17.5 | −18.4 |
| 3.0 | — | — | 0.1 | −15.2 | −14.8 | −16.6 | −20.4 |
| 3.0 | — | — | 1.0 | −10.2 | −14.7 | −15.2 | −16.2 |
| 0.5 | — | — | 0.3 | −10.5 | −15.0 | −12.3 | −15.3 |
| 0.1 | 0.1 | — | 0.1 | − 5.1 | −12.0 | −10.4 | −12.4 |
| 0.1 | 0.1 | — | 1.0 | − 4.5 | −11.5 | − 9.8 | −10.9 |
| 0.1 | 3.0 | — | 0.1 | − 4.8 | −12.1 | −11.2 | −13.4 |
| 0.1 | 3.0 | — | 1.0 | − 5.0 | −11.6 | −10.4 | −11.2 |
| 3.0 | 0.1 | — | 0.1 | − 5.0 | −11.8 | − 6.7 | − 7.5 |
| 3.0 | 0.1 | — | 1.0 | − 5.1 | −11.2 | − 8.6 | − 9.8 |
| 3.0 | 3.0 | — | 0.1 | − 5.0 | −10.8 | − 9.3 | −10.4 |
| 3.0 | 3.0 | — | 1.0 | − 4.5 | −11.2 | − 8.4 | − 7.9 |
| 0.5 | 0.5 | — | 0.3 | − 4.0 | −10.3 | − 7.3 | − 8.5 |
| 0.1 | — | 0.1 | 0.1 | − 3.6 | − 9.5 | −10.3 | −10.3 |
| 0.1 | — | 0.1 | 1.0 | − 3.4 | − 9.8 | − 9.4 | −10.2 |
| 0.1 | — | 3.0 | 0.1 | − 3.2 | − 9.2 | − 8.3 | − 9.4 |
| 0.1 | — | 3.0 | 1.0 | − 3.0 | − 8.9 | − 5.6 | − 6.5 |
| 3.0 | — | 0.1 | 0.1 | − 3.1 | − 7.5 | − 7.4 | − 8.7 |
| 3.0 | — | 0.1 | 1.0 | − 3.0 | − 7.0 | − 8.2 | − 6.8 |
| 3.0 | — | 3.0 | 0.1 | − 3.2 | − 6.8 | − 8.5 | − 5.6 |
| 3.0 | — | 3.0 | 1.0 | − 3.6 | − 7.0 | − 7.4 | − 4.5 |
| 0.5 | — | 0.5 | 0.3 | − 3.0 | − 6.2 | − 6.8 | − 4.3 |
| 0.1 | 0.1 | 0.1 | 0.1 | − 2.2 | − 5.2 | − 3.2 | − 5.0 |
| 0.1 | 0.1 | 0.1 | 1.0 | − 1.8 | − 3.0 | − 2.8 | − 2.4 |
| 3.0 | 3.0 | 3.0 | 0.1 | − 2.1 | − 3.2 | − 4.1 | − 3.0 |
| 3.0 | 3.0 | 3.0 | 1.0 | − 2.0 | − 2.5 | − 2.2 | − 2.5 |
| 0.5 | 0.5 | 0.5 | 0.3 | − 0.8 | − 1.2 | − 0.7 | − 1.1 |

Beryllium

Table 6-continued

| Additive (mole %) | | | | Change rates of electrical characteristics after test | | | |
|---|---|---|---|---|---|---|---|
| | | | | Load life test (%) | | Heat cycle test (%) | |
| Bismuth oxide | Cobalt oxide | Manganese oxide | Fluoride | Δc | Δn | Δc | Δn |
| | | | fluoride | | | | |
| 0.1 | — | — | 0.5 | −11.5 | −16.0 | −14.0 | −15.4 |
| 0.1 | — | — | 1.0 | −12.1 | −15.0 | −13.4 | −13.8 |
| 3.0 | — | — | 0.5 | −12.3 | −14.5 | −11.3 | −12.4 |
| 3.0 | — | — | 1.0 | −11.5 | −13.0 | −10.5 | −11.3 |
| 0.5 | — | — | 0.8 | −10.5 | −11.5 | −9.5 | −10.4 |
| 0.1 | 0.1 | — | 0.5 | −7.2 | −8.5 | −6.3 | −8.4 |
| 0.1 | 3.0 | — | 0.5 | −6.5 | −7.5 | −5.9 | −7.2 |
| 3.0 | 0.1 | — | 0.5 | −6.7 | −7.8 | −6.5 | −8.8 |
| 3.0 | 3.0 | — | 0.5 | −6.0 | −7.2 | −6.7 | −8.5 |
| 0.5 | 0.5 | — | 0.8 | −6.2 | −8.5 | −6.2 | −7.2 |
| 0.1 | — | 0.1 | 1.0 | −4.8 | −6.2 | −3.8 | −4.7 |
| 0.1 | — | 3.0 | 1.0 | −4.0 | −7.2 | −4.0 | −5.2 |
| 3.0 | — | 0.1 | 1.0 | −4.1 | −5.6 | −3.6 | −4.5 |
| 3.0 | — | 3.0 | 1.0 | −4.2 | −4.4 | −3.4 | −4.1 |
| 0.1 | 0.1 | 0.1 | 0.5 | −3.3 | −3.5 | −2.6 | −2.7 |
| 3.0 | 3.0 | 3.0 | 1.0 | −2.4 | −3.4 | −2.4 | −2.5 |
| 0.5 | 0.5 | 0.5 | 0.8 | −0.9 | −1.5 | −0.9 | −1.4 |
| | | | Cerium fluoride | | | | |
| 0.1 | — | — | 0.5 | −10.5 | −11.3 | −11.8 | −11.9 |
| 0.1 | — | — | 1.0 | −11.4 | −14.5 | −12.4 | −13.0 |
| 3.0 | — | — | 0.5 | −9.8 | −10.3 | −10.8 | −12.0 |
| 3.0 | — | — | 1.0 | −9.7 | −10.2 | −11.0 | −13.4 |
| 0.5 | — | — | 0.8 | −9.6 | −9.7 | −10.4 | −12.2 |
| 0.1 | 0.1 | — | 0.5 | −7.4 | −8.6 | −4.0 | −6.5 |
| 0.1 | 3.0 | — | 0.5 | −6.8 | −8.7 | −4.1 | −5.3 |
| 3.0 | 0.1 | — | 0.5 | −6.6 | −7.8 | −4.3 | −5.0 |
| 3.0 | 3.0 | — | 0.5 | −7.2 | −7.4 | −5.1 | −6.3 |
| 0.5 | 0.5 | — | 0.8 | −6.7 | −6.7 | −5.0 | −4.8 |
| 0.1 | — | 0.1 | 1.0 | −5.3 | −5.8 | −4.3 | −5.2 |
| 0.1 | — | 3.0 | 1.0 | −6.1 | −6.4 | −3.9 | −4.7 |
| 3.0 | — | 0.1 | 1.0 | −5.0 | −5.0 | −4.0 | −3.8 |
| 3.0 | — | 3.0 | 1.0 | −4.8 | −4.9 | −3.8 | −4.5 |
| 0.1 | 0.1 | 0.1 | 0.5 | −3.1 | −3.7 | −2.9 | −3.0 |
| 3.0 | 3.0 | 3.0 | 1.0 | −3.5 | −3.8 | −2.8 | −2.9 |
| 0.5 | 0.5 | 0.5 | 0.8 | −1.5 | −1.6 | −0.6 | −0.8 |
| | | | Nickel fluoride | | | | |
| 0.1 | — | — | 0.5 | −9.5 | −10.3 | −8.4 | −10.4 |
| 0.1 | — | — | 2.5 | −9.2 | −11.2 | −8.6 | −9.1 |
| 3.0 | — | — | 0.5 | −9.3 | −9.8 | −8.1 | −8.4 |
| 3.0 | — | — | 2.5 | −9.1 | −10.4 | −7.8 | −9.2 |
| 0.5 | — | — | 1.0 | −9.3 | −10.2 | −8.5 | −10.4 |
| 0.1 | 0.1 | — | 2.5 | −7.2 | −7.4 | −6.5 | −7.2 |
| 0.1 | 3.0 | — | 2.5 | −7.3 | −8.5 | −7.1 | −7.6 |
| 3.0 | 0.1 | — | 2.5 | −7.4 | −8.6 | −6.7 | −6.9 |
| 3.0 | 3.0 | — | 2.5 | −6.7 | −7.2 | −7.5 | −8.4 |
| 0.1 | — | 0.1 | 0.5 | −6.5 | −8.5 | −6.4 | −6.9 |
| 0.1 | — | 3.0 | 0.5 | −6.3 | −7.3 | −5.8 | −7.0 |
| 3.0 | — | 0.1 | 0.5 | −5.9 | −6.1 | −5.5 | −6.3 |
| 3.0 | — | 3.0 | 0.5 | −6.7 | −7.0 | −6.2 | −6.1 |
| 0.5 | — | 0.5 | 1.0 | −6.4 | −6.6 | −5.1 | −5.4 |
| 0.1 | 0.1 | 0.1 | 0.5 | −2.4 | −2.6 | −3.0 | −3.0 |
| 3.0 | 3.0 | 3.0 | 2.5 | −3.2 | −3.3 | −2.4 | −2.6 |
| 0.5 | 0.5 | 0.5 | 1.0 | −1.1 | −1.5 | −1.0 | −1.2 |
| | | | Vanadium fluoride | | | | |
| 0.1 | — | — | 1.0 | −10.1 | −11.2 | −8.2 | −9.1 |
| 0.1 | — | — | 2.0 | −10.5 | −10.7 | −8.4 | −8.4 |
| 3.0 | — | — | 1.0 | −10.0 | −11.4 | −8.1 | −8.0 |
| 3.0 | — | — | 2.0 | −9.8 | −9.9 | −7.2 | −7.5 |
| 0.5 | — | — | 1.5 | −9.6 | −9.8 | −7.0 | −8.0 |
| 0.1 | 0.1 | — | 1.0 | −6.7 | −7.2 | −5.0 | −6.0 |
| 0.1 | 3.0 | — | 1.0 | −5.8 | −6.0 | −4.8 | −5.1 |
| 3.0 | 0.1 | — | 1.0 | −6.5 | −6.8 | −6.2 | −6.3 |
| 3.0 | 3.0 | — | 1.0 | −6.6 | −6.8 | −6.0 | −6.0 |
| 0.5 | 0.5 | — | 1.5 | −5.0 | −5.9 | −4.7 | −4.8 |
| 0.1 | — | 0.1 | 1.5 | −7.0 | −7.9 | −6.0 | −4.9 |
| 0.1 | — | 3.0 | 2.0 | −6.7 | −7.0 | −5.8 | −5.4 |
| 3.0 | — | 0.1 | 2.0 | −6.0 | −7.0 | −5.1 | −5.3 |
| 3.0 | — | 3.0 | 2.0 | −5.5 | −6.0 | −4.8 | −5.0 |
| 0.1 | 0.1 | 0.1 | 1.0 | −3.4 | −3.8 | −2.1 | −2.8 |
| 3.0 | 3.0 | 3.0 | 2.0 | −2.6 | −2.8 | −2.0 | −2.0 |
| 0.5 | 0.5 | 0.5 | 1.5 | −1.0 | −1.4 | −0.6 | −0.6 |

What is claimed is:

1. A voltage variable resistor comprising a sintered body consisting essentially of, as a major part, zinc oxide and an additive consisting essentially of 0.1 to 3.0 mole % of bismuth oxide and one member selected from the group consisting of 0.1 to 1.0 mole % of aluminum fluoride, 0.5 to 1.0 mole % of beryllium fluoride, 0.5 to 1.0 mole % of cerium fluoride, 0.5 to 2.5 mole % of nickel fluoride, and 1.0 to 2.0 mole % of vanadium fluoride, and electrodes applied to opposite surfaces of said sintered body.

2. A voltage variable resistor comprising a sintered body consisting essentially of, as a major part, zinc oxide and an additive consisting essentially of 0.1 to 3.0 mole % of bismuth oxide, 0.1 to 3.0 mole % of cobalt oxide and one member selected from the group consisting of 0.1 to 1.0 mole % of aluminum fluoride, 0.5 to 1.0 mole % of beryllium fluoride, 0.5 to 1.0 mole % of cerium fluoride, 0.5 to 2.5 mole % of nickel fluoride, and 1.0 to 2.0 mole % of vanadium fluoride, and electrodes applied to opposite surfaces of said sintered body.

3. A voltage variable resistor comprising a sintered body consisting essentially of, as a major part, zinc oxide and an additive consisting essentially of 0.1 to 3.0 mole % of bismuth oxide, 1.0 to 3.0 mole % of manganese oxide and one member selected from the group consisting of 0.1 to 1.0 mole % of aluminum fluoride, 0.5 to 1.0 mole % of beryllium fluoride, 0.5 to 1.0 mole % of cerium fluoride, 0.5 to 2.5 mole % of nickel fluoride, and 1.0 to 2.0 mole % of vanadium fluoride, and electrodes applied to opposite surfaces of said sintered body.

4. A voltage variable resistor comprising a sintered body consisting essentially of, as a major part, zinc oxide and an additive consisting essentially of 0.1 to 3.0 mole % of bismuth oxide, 0.1 to 3.0 mole % of cobalt oxide, 0.1 to 3.0 mole % of manganese oxide and one member selected from the group consisting of 0.1 to 1.0 mole % of aluminum fluoride, 0.5 to 1.0 mole % of beryllium fluoride, 0.5 to 1.0 mole % of cerium fluoride, 0.5 to 2.5 mole % of nickel fluoride, and 1.0 to 2.0 mole % of vanadium fluoride, and electrodes applied to opposite surfaces of said sintered body.

* * * * *